US005802725A

United States Patent [19]

Drifka et al.

[11] Patent Number: 5,802,725

[45] **Date of Patent: *Sep. 8, 1998**

[54] PORTABLE METAL DRUM OPENING APPARATUS

[75] Inventors: Brian N. Drifka, Pewaukee; Bruce A. Cincotta, Wauwatosa; Arthur L. Thomas, Milwaukee, all of Wis.

[73] Assignee: Hydro-Thermal Corporation, Waukesha, Wis.

[ * ] Notice: The term of this patent shall not extend beyond the expiration date of Pat. No. 5,651,183.

[21] Appl. No.: 418,246

[22] Filed: Apr. 6, 1995

[51] Int. Cl.[6] ..... B67B 7/60; B67B 7/68

[52] U.S. Cl. ..... 30/417; 30/416; 30/424; 30/426; 29/426.4

[58] Field of Search ..... 30/416, 417, 418, 30/422, 424, 425, 427, 434, 400, 401, 403, 405, 410, 412, 413, 415, 426; 29/426.5, 426.4, 426.3

[56] References Cited

U.S. PATENT DOCUMENTS

| | | | |
|---|---|---|---|
| 2,252,406 | 8/1941 | O'Brien . | |
| 2,554,265 | 5/1951 | Parovel | 30/425 |
| 2,673,058 | 3/1954 | Tyler | 30/416 |
| 2,677,175 | 5/1954 | Wild | 30/425 |
| 2,886,887 | 5/1959 | Krist et al. . | |
| 3,110,962 | 11/1963 | Krist et al. . | |
| 3,117,373 | 1/1964 | Wallace . | |
| 3,161,952 | 12/1964 | Czapiewski . | |
| 3,667,120 | 6/1972 | Krist . | |
| 3,739,472 | 6/1973 | Peres . | |
| 3,745,650 | 7/1973 | Derwin . | |
| 3,898,898 | 8/1975 | Peres | 82/47 |
| 4,169,313 | 10/1979 | Thurmond, Jr. | 30/432 |
| 4,251,917 | 2/1981 | Peres | 30/403 |
| 4,604,806 | 8/1986 | Pelczynski | 30/417 |
| 5,170,565 | 12/1992 | Brisard | 30/401 |
| 5,347,720 | 9/1994 | Pereira | 30/416 |
| 5,349,755 | 9/1994 | Haywood | 30/443 |
| 5,361,502 | 11/1994 | Derwin | 30/431 |
| 5,651,183 | 7/1997 | Cincotta et al. | 30/417 |

FOREIGN PATENT DOCUMENTS

| | | | |
|---|---|---|---|
| 186518 | 5/1907 | Germany | 30/417 |
| 257039 | 2/1913 | Germany | 30/427 |
| 1516291 | 10/1989 | Russian Federation | 29/426.5 |

OTHER PUBLICATIONS

Wizard Drum Deheader Brochures: "Heavy Duty Wizard Drum Deheader", Bulletin: W3001; Wizard Drum Tool Co., Drum Deheader—Self Propelled (Model F), WLT–102; and Wizard Drum Tool Co., Drum Head Lifter, Bulletin W–1300. (Prior art).

Wizard Drum Tool Co., "Portable, Self–Propelled Steel Drum Deheaders" (Prior art).

Wizard Drum Tool Co. Information From The Industry Leader Brochures: "Deheader Accessories", WLY–115; Wizard, the proven drum deheader just got better, WLY–101; Drum Deheader—Self Propelled (Model G), WLS–101; Drum Deheader—Self Propelled (Model J), WLS–102; Drum Deheader—Self–Propelled (Model H), WLT–101; Automatic Air Deheader WLY–102; and Manual Drum Deheader, WLT–103. (Prior Art).

*Primary Examiner*—Eugenia Jones
*Assistant Examiner*—Charles Goodman
*Attorney, Agent, or Firm*—Andrus, Sceales, Starke & Sawall

[57] ABSTRACT

Portable metal drum openers allow the use of a cutting head with a relatively small diameter so that most metal drum covers can be removed without having to beat down or remove bungs in the cover. The cutting head is spring mounted so that the small diameter cutting head will not slip or stall when encountering a kink in the chime. The cutting head is tilted downward in the direction of cutting so that the cutting head would tend to move downward along the chime when making the cut, however, the cutting head is physically restrained from moving downward past a selected chime cutting height. The selected chime cutting height is preferably adjusted by adjusting the position of a shaft collar along threads on a cutting shaft that projects perpendicularly from the cutting head. It is preferred that the drum opener be driven either manually, or by an electric DC motor.

17 Claims, 8 Drawing Sheets

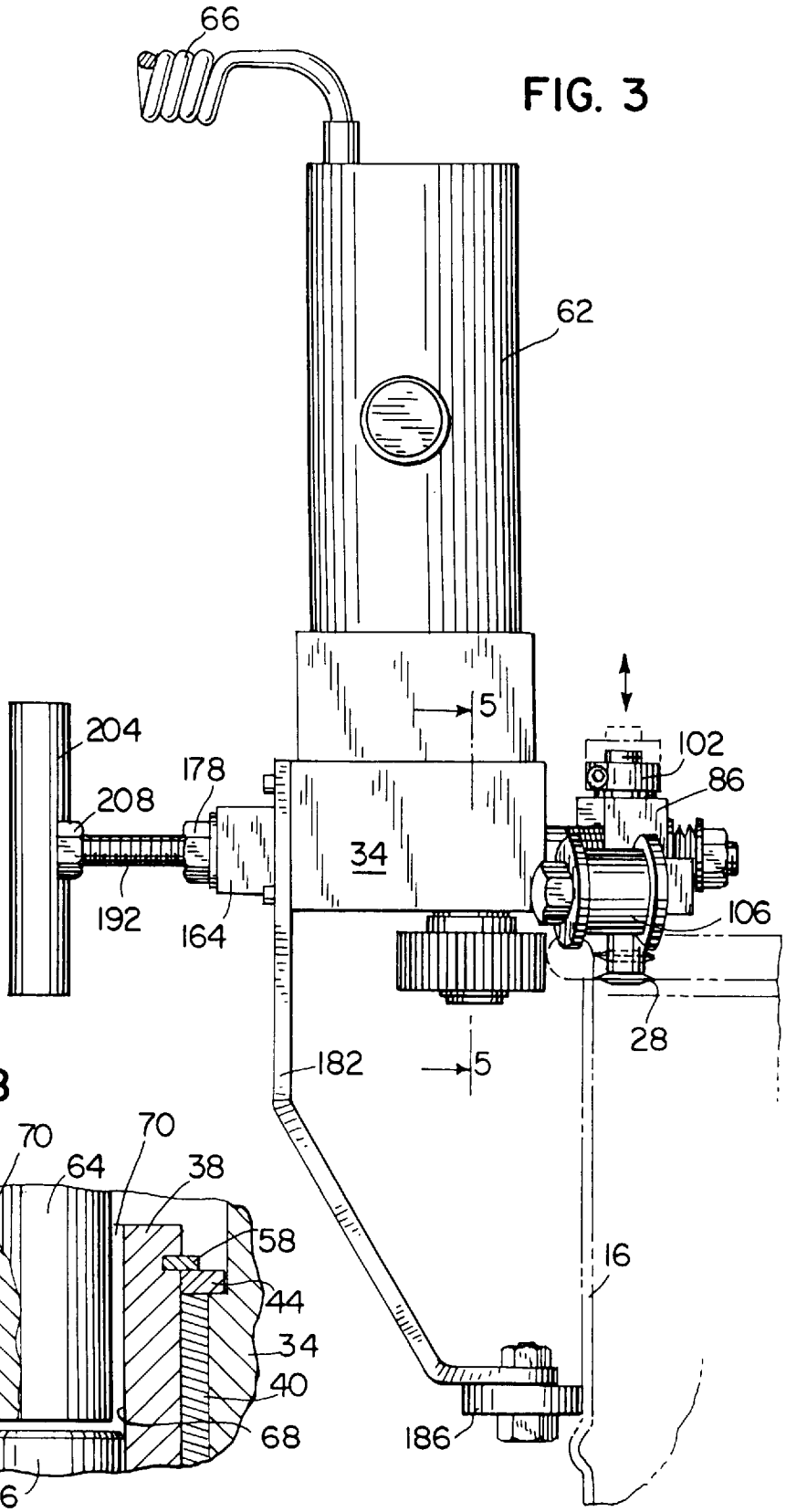
FIG. 3
FIG. 8
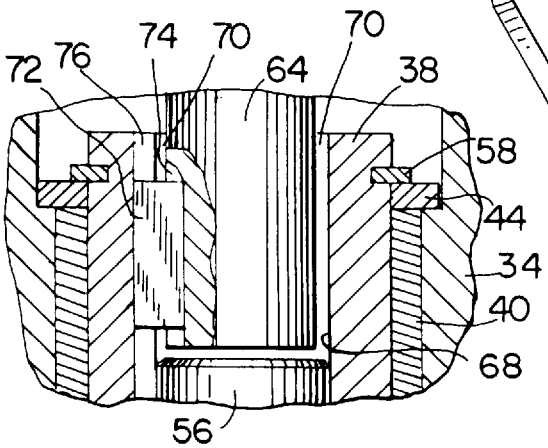

FIG. 5
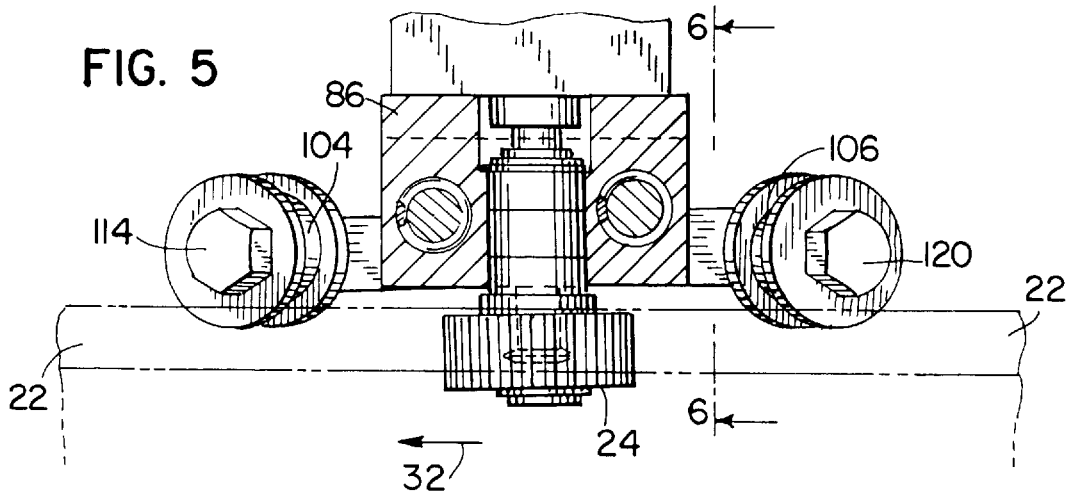
FIG. 6
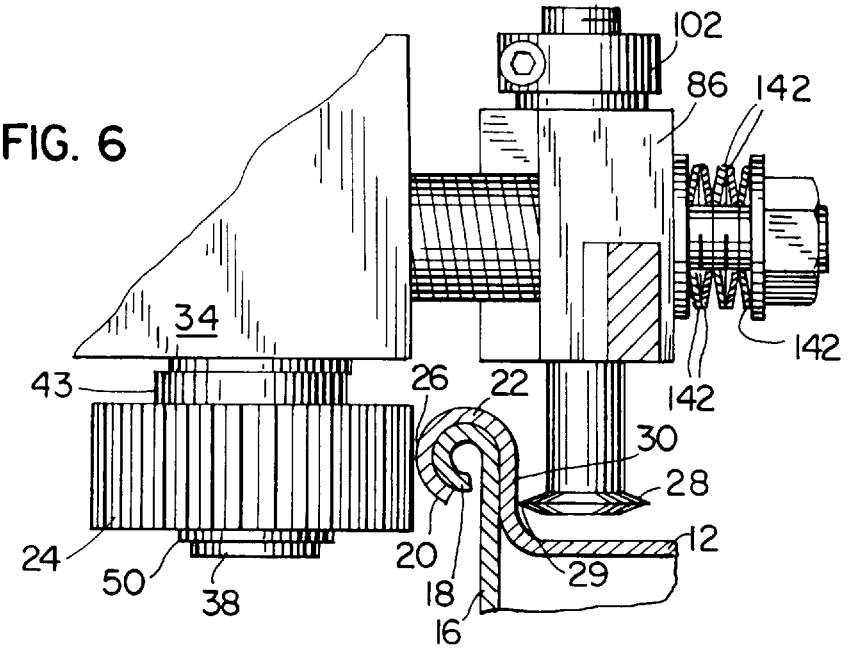
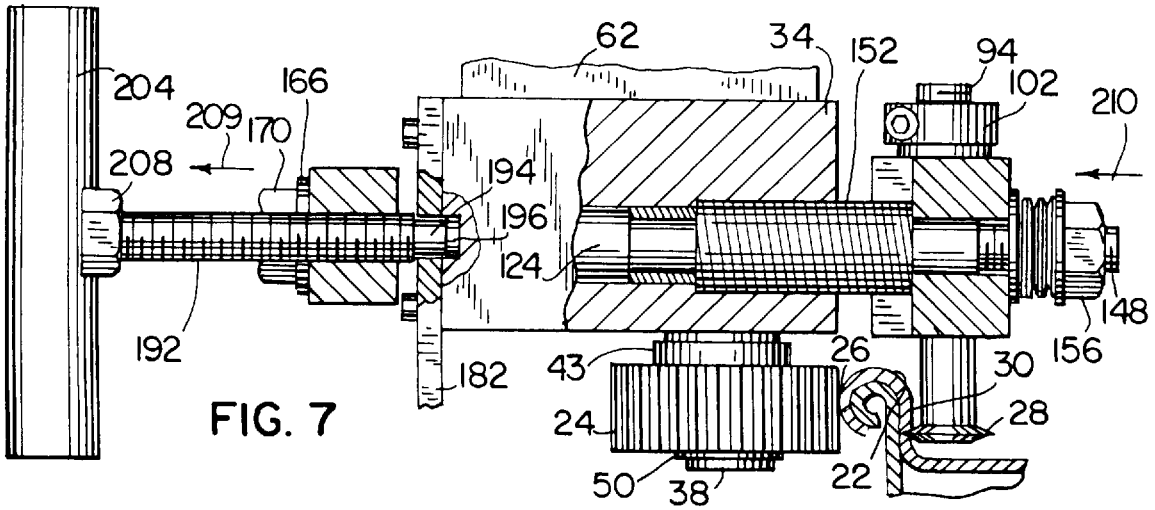
FIG. 7

PORTABLE METAL DRUM OPENING APPARATUS

BACKGROUND OF THE INVENTION

Large industrial metal drums normally have a metal cover that is secured to an upper edge of the cylindrical wall of the drum by a rolled chime. Metal drum openers can be used to remove the metal drum cover. The invention relates to improvements in portable metal drum openers.

In one type of portable metal drum opener, a drive wheel engages an outer surface of the drum chime, and a cutting head is located opposite the drive wheel and engages an inner surface of the chime to cut the inner metal layer of the chime. The height of the cutting head is normally fixed in relation to the drive wheel. A drive means drives the drive wheel and the opener travels around the chime at the upper end of the drum in such a manner that the cutting head cuts the inside layer of the chime around the entire chime to release the cover. Portable metal drum openers are either powered manually, driven by an electric AC motor or driven by some other means of power such as compressed air.

Large industrial drums come in generally 55 gallon and 30 gallon sizes, but chime configuration and particularly the height of chimes are not standard in the industry. Each type of chime can be cut most effectively at an optimized chime cutting height. Fixed-height cutting wheels do not in general allow the chime cutting height to be optimized for a variety of chime configurations. It is therefor desirable to provide a portable metal drum opener that can easily adjust the chime cutting height at which the cutting head cuts the chime.

Most metal drum openers use cutting heads with relatively large diameters. Small diameter cutting heads require more torque when kinks in the chime are encountered than large diameter cutting heads, and using a small diameter cutting head with conventional metal drum openers can therefore cause problems especially when kinks in the chime are encountered. Large diameter cutting heads can more easily work through kinks or bumps in the chime. Manually powered openers with small diameter cutting heads are likely to slip, whereas conventional electric powered openers with small diameter cutting heads may slip but can also stall.

Many industrial metal drums have a removable bung or plug in a threaded opening through the drum cover. Contents in the drum can be poured from the threaded opening. The bung often projects above the cover and is often located close to the chime. A raised bung can interfere with the path of conventional large diameter cutting heads as the drum opener travels around the chime at the upper end of the drum. If a raised bung interferes with the cutting head, the bung needs to be removed or beaten flat with a mallet.

It is therefor also desirable to provide a portable metal drum opener that can use small diameter cutting heads and reduce inconvenience relating to interference caused by bungs in drum covers, and that can accommodate variations in chime geometry such as variations in chime height or chime kinks.

SUMMARY OF THE INVENTION

An object of the invention is to provide a portable metal drum opener that is versatile and can easily adjust to accommodate various drum and chime configurations. Another object of the invention is to provide such a metal drum opener that allows the use of a cutting head with a relatively small diameter, thus eliminating the need to beat down or remove bungs in the cover of most drums.

In one aspect the invention relates to a method for adjusting the chime cutting height on the inside surface of the chime and apparatus for carrying out the method. The method includes the steps of engaging a rotatable drive wheel against an outer surface of a chime and engaging a rotatable cutting head against the inner surface of an inside layer of the chime, driving the rotatable drive wheel to move the drive wheel and the cutting head in a cutting direction around the chime to cut the inside layer of the chime, tilting the cutting head downward in the cutting direction so that the cutting head will tend to move downward along the chime during cutting, and physically restraining the tilted cutting head from moving downward past a selected chime cutting height so that the cut along the inside layer of the chime is at the selected chime cutting height.

The preferred apparatus for tilting the cutter head downward in the cutting direction and physically restraining the tilted cutting head from moving downward past the selected chime cutting height allows the selected chime cutting height to be adjusted easily. In particular, such a drum opener includes a carrier having a generally vertical drive shaft bearing hole. A drive shaft journaled within the drive shaft bearing hole to which a rotatable drive wheel is mounted in such a manner that the drive wheel is disposed to engage an outer surface of the drum chime. The opener also includes a front housing having a generally vertical cutter shaft bearing hole. A rotatable cutting wheel, has a cutting head and a perpendicularly projecting cutter shaft, the cutter shaft is slidably mounted through the cutter shaft bearing hole in the front housing in such a manner that the cutting head is disposed to engage the inner surface of an inside layer of the chime. A cutting wheel stop limits the lowest position relative to the front housing that the cutting head can slide. The preferred cutting wheel stop is a threaded shaft collar that can be adjustably positioned onto threads at the top end of the cutter shaft which are exposed above the front housing. The preferred means for tilting the cutting head downward in a cutting direction is to tilt the entire opener downward in the cutting direction. A practical way of tilting the opener involves the way the opener is supported on the drum chime. The opener is supported on the drum chime by a chime roller in the cutting direction and by a chime roller in the trailing direction. The chime rollers are supported on chime roller axles which are attached to the opener, preferably attached to the front housing or a chime roller bracket. By offsetting the height at which the chime roller axles are attached to the opener so that the chime roller axle in the cutting direction is higher relative to the chime roller bracket in the trailing direction, the opener and in particular the cutting head can be tilted downward in the cutting direction.

In another aspect, the invention relates to methods and apparatus that allow the use of cutting heads with smaller diameters. One feature that facilitates the use of a smaller diameter cutting head is spring mounting the cutting wheel to cushion the engagement of the cutting head against the inner surface of the chime so that the cutting head can deflect when the cutting head encounters kinks in the chime. The preferred spring element uses disk spring washers when slidably mounting the cutting assembly (e.g. the front housing) to the carrier.

In accordance with the invention, there are two preferred ways to power the metal drum opener. One preferred way is to use an electric direct current (DC) motor. A DC motor is preferred over an alternating current (AC) motor because DC motors can more easily accommodate kinks without stalling than AC motors. In order to eliminate or lessen transverse loads on an output shaft of the electric motor and therefor enhance the durability of the electric motor, a transverse clearance is provided between the output shaft of the electric motor and the drive shaft.

The other preferred way to power the opener is to use a manually powered gear drive. In a manually powered unit, it is desirable that the inside layer of the chime be fully cut after only one revolution of the drum chime. Therefore, it is desirable that the cutting head in the manual unit engage the inside surface of the chime with more force than in the electric unit. The manual unit is preferably driven by a ratchet wrench that acts as a removable handle to drive a gear which in turn drives the drive wheel. The gear drive has a preferred gear ratio of 2:1. In the manual unit, torque to the drive wheel is not typically constant. In order to prevent slipping, the drive wheel preferably has a knurled edge in which the teeth on the knurled edge are substantially vertical and in which there are no more than ten teeth per inch. In addition, it is preferred that guide rollers for stabilizing the opener against the drum side wall be adjustable so that the height of the guide rollers can correspond with the height of a circumferential strength rib around the drum side wall. This can help prevent denting of the side wall of the drum, or the opener from otherwise becoming unstable.

The invention thus provides portable metal drum openers that allow the use of a small diameter cutter head so that most metal drum covers can be removed without having to beat down or remove bungs in the cover. The invention allows efficient removal of drum covers even when the chime has been bent or kinked. The invention also allows easy adjustment of the chime cutting height to accommodate various chime configurations. Other more specific features of the invention should be apparent to those skilled in the art.

BRIEF DESCRIPTION OF THE DRAWINGS

FIG. 3 is a side elevational view of the portable, electric drum opener shown in FIG. 1;

FIG. 5 is an elevational view taken along lines 5—5 in FIG. 3;

FIG. 6 is a detailed side elevational view taken along lines 6—6 in FIG. 5;

FIG. 7 is a side elevational view of a portion of the portable, electric metal drum opener shown in FIG. 1 showing a cutting head engaged against an inside metal layer of a chime to cut the inside metal layer of the chime;

FIG. 8 is a detailed view showing the interconnection between an output shaft of an electric motor to a drive shaft in the portable, electric metal drum opener shown in FIG. 1;

DETAILED DESCRIPTION OF THE PREFERRED EMBODIMENTS

Figure 1:
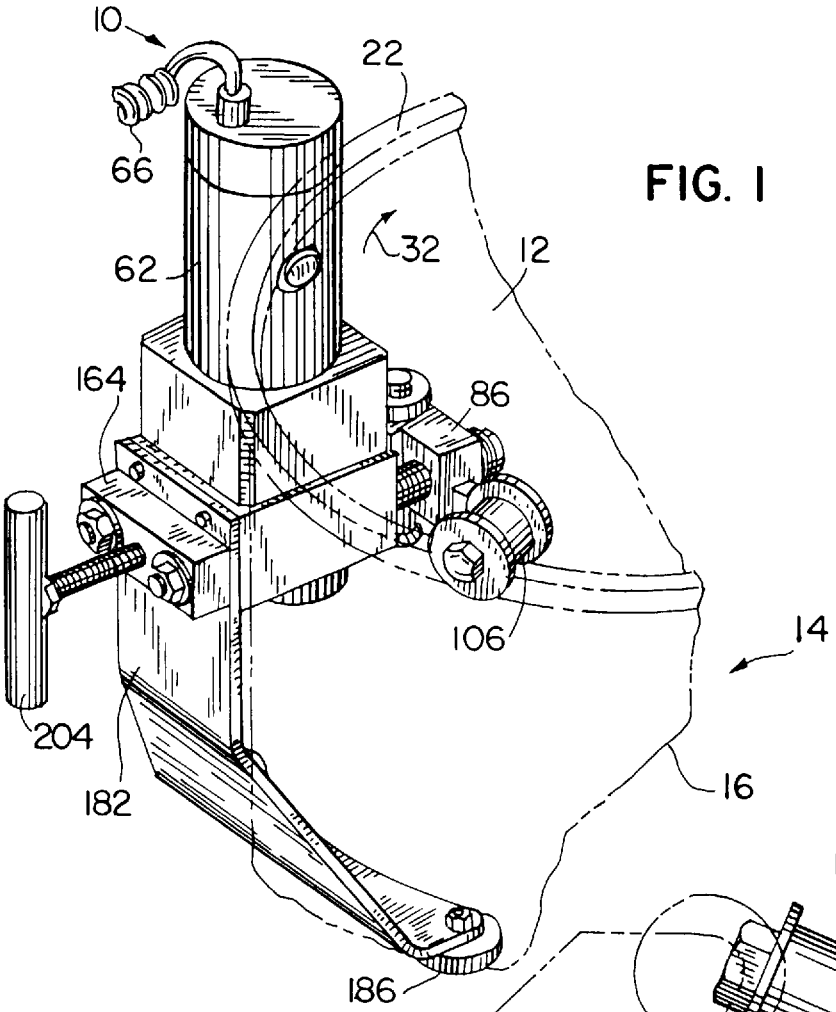
FIG. 1 is a perspective view of a portable, electric metal drum opener in accordance with the invention.
Figure 4:
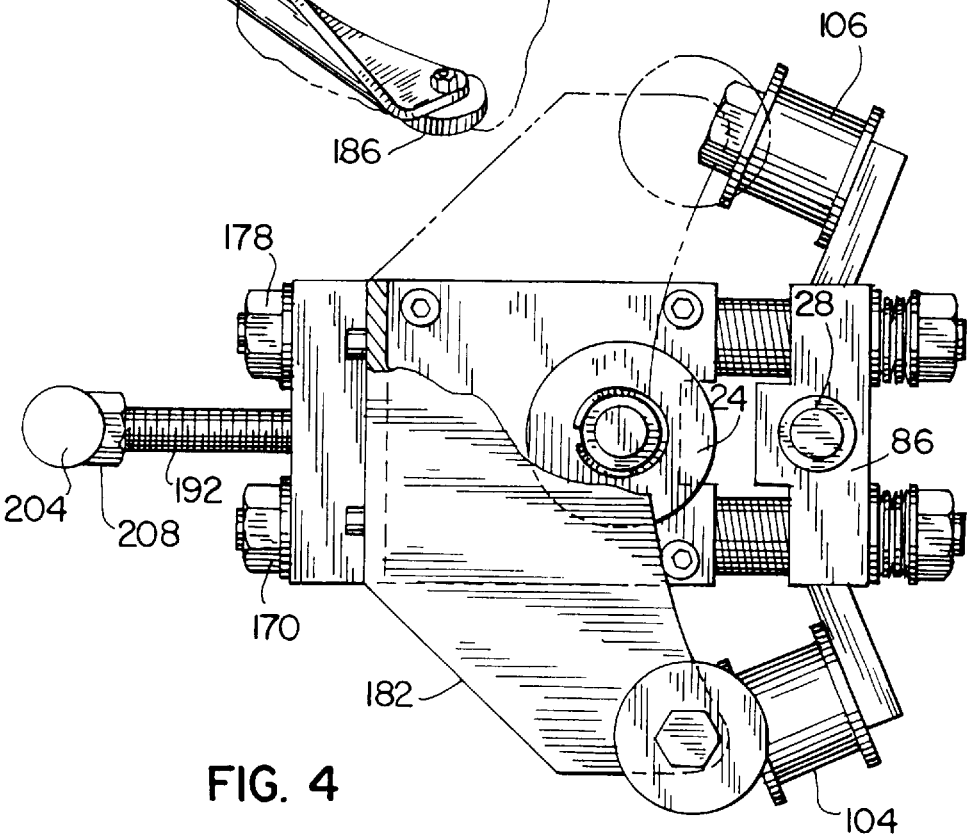
FIG. 4 is a bottom view of the portable, electric metal drum opener shown in FIG. 1.

FIGS. 1–8 illustrate a portable, electric metal drum opener 10 that is used to remove a metal cover 12 from a large metal drum 14. The metal drum 14 includes a generally cylindrical metal side wall 16, a metal bottom (not shown) and a metal cover 12. As shown best in FIG. 6, an upper edge 18 of the cylindrical side wall 16 and a peripheral edge 20 of the cover 12 are rolled to form a chime 22. The opener 10 has a drive wheel 24 that engages an outer surface 26 of the chime 22, and a cutting head 28 which engages an inner surface 29 of an inside layer 30 of the chime 22 to cut the inside layer 30 of the chime. The preferred diameter of the cutting head is about one inch. Referring to FIG. 1, when the drive wheel 24 is driven to rotate, the opener 10 travels in a cutting direction (which is shown by arrow 32) around the chime 22 at the upper end of the drum 14. Depending on the amount of engagement force between the drive wheel 24 and the cutting head 28, it may take one but preferably two or three revolutions around the upper end of the drum 14 to fully cut the inside layer 30 of the chime and release the cover 12.

Figure 2:
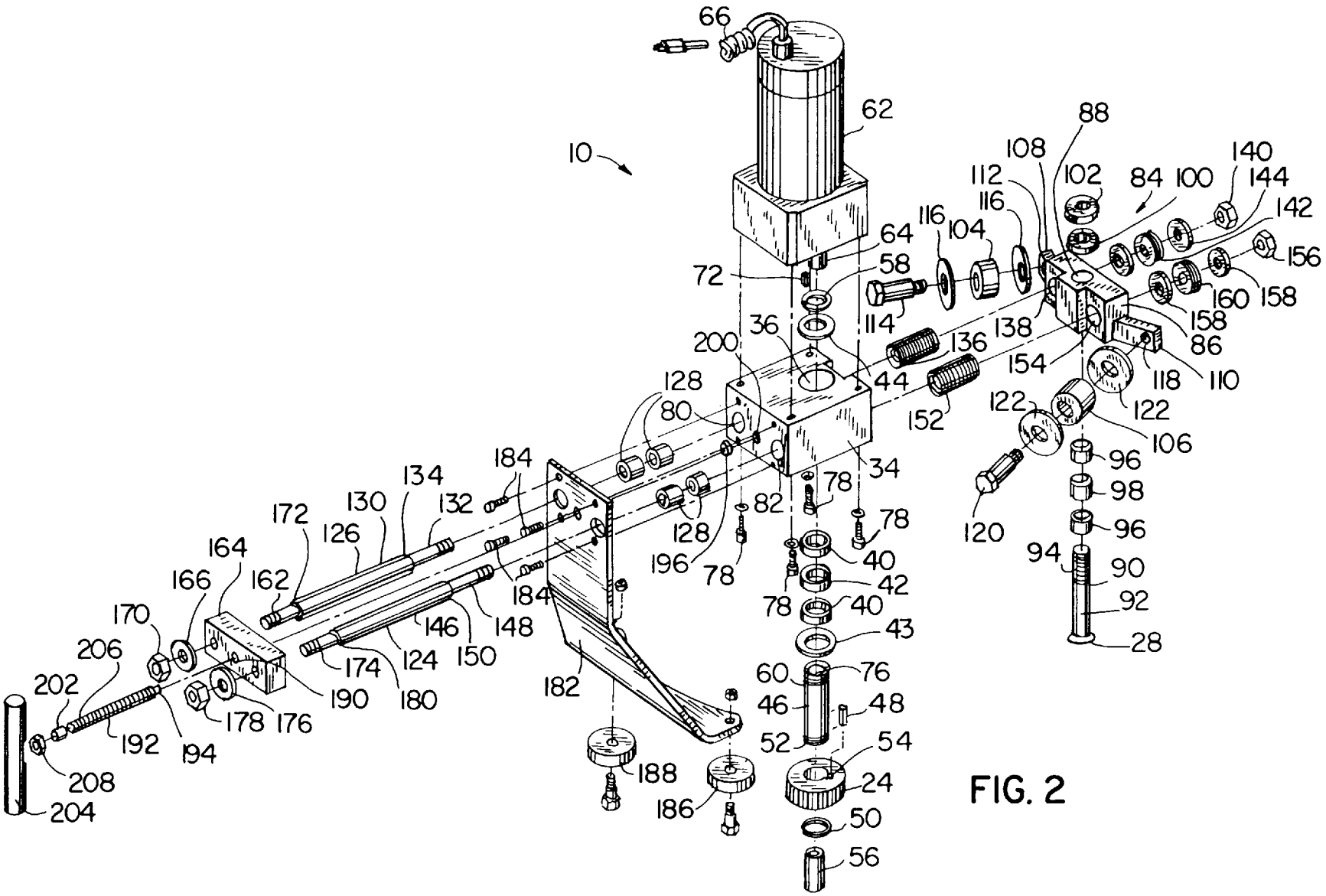
FIG. 2 is an exploded assembly view of the portable, electric metal drum opener shown in FIG. 1.
Figure 9:
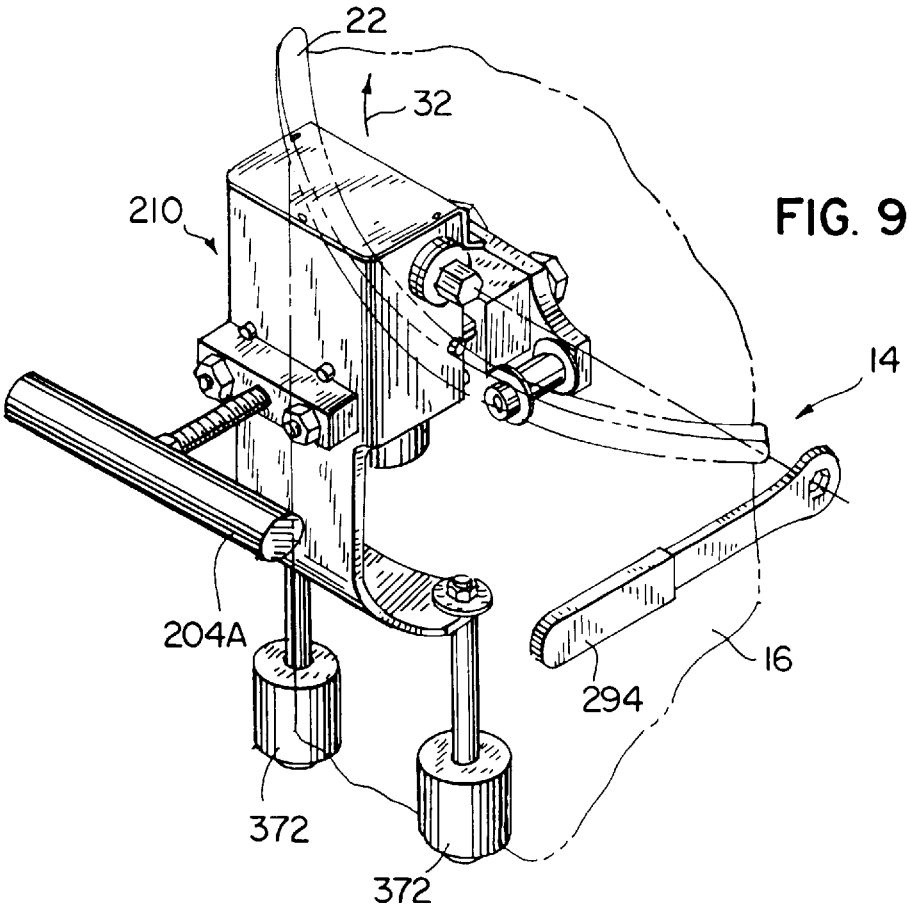
FIG. 9 is a perspective view of a portable, manually powered metal drum opener in accordance with the invention.
Figure 10:
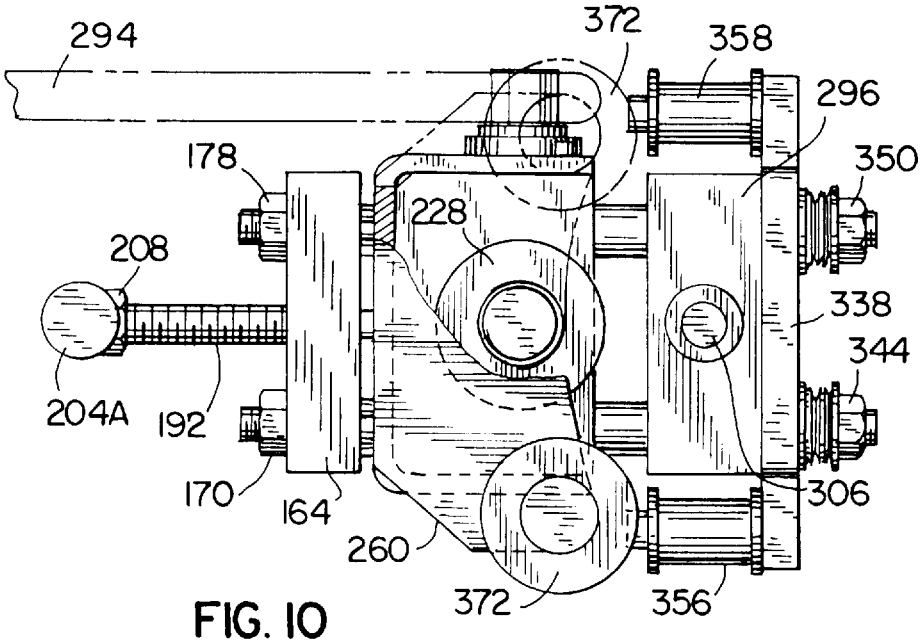
FIG. 10 is a bottom view of the portable, manually powered metal drum opener shown in FIG. 9.
Figure 11:
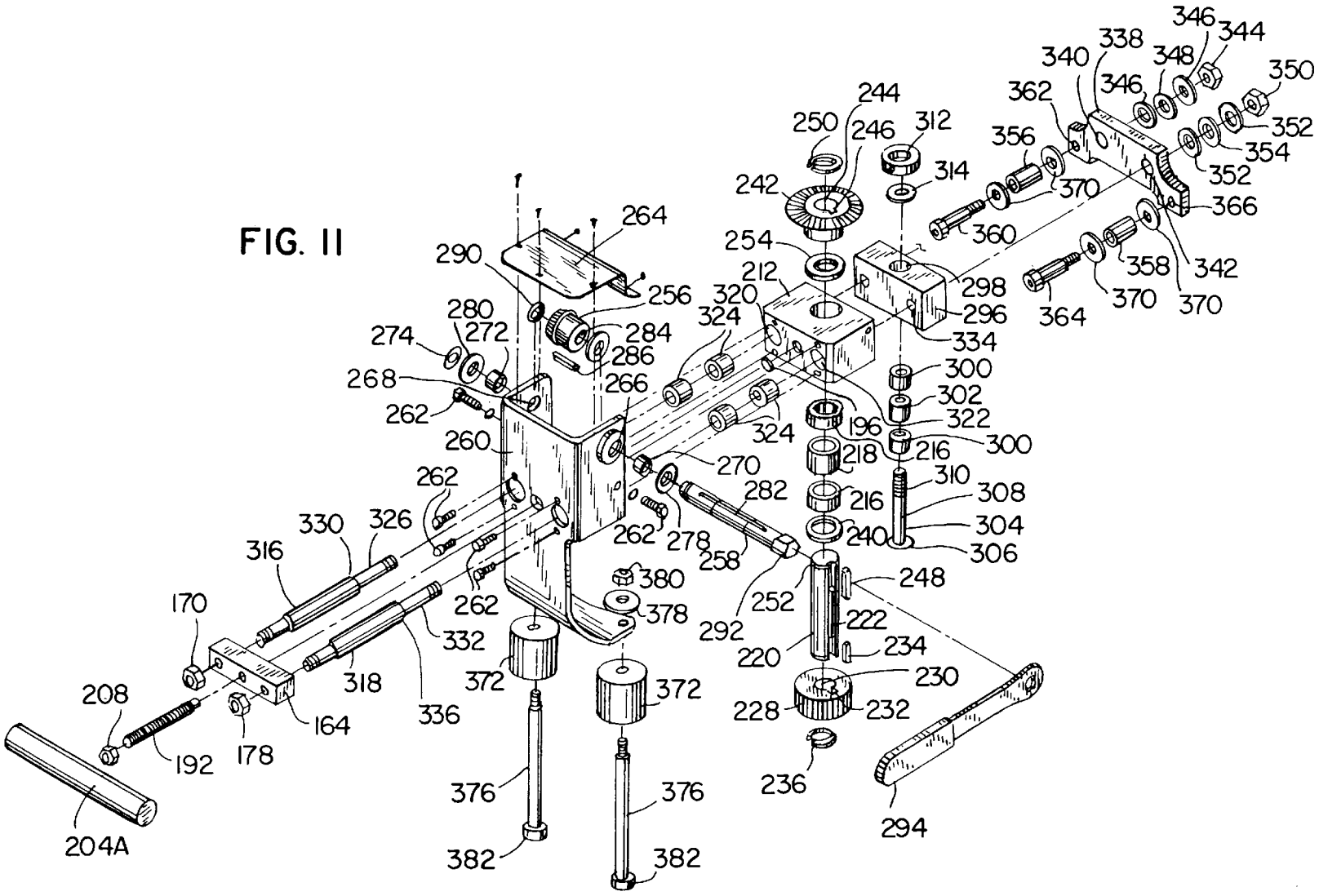
FIG. 11 is an exploded assembly view of the portable, manually powered metal drum opener shown in FIG. 9.
Figure 12:
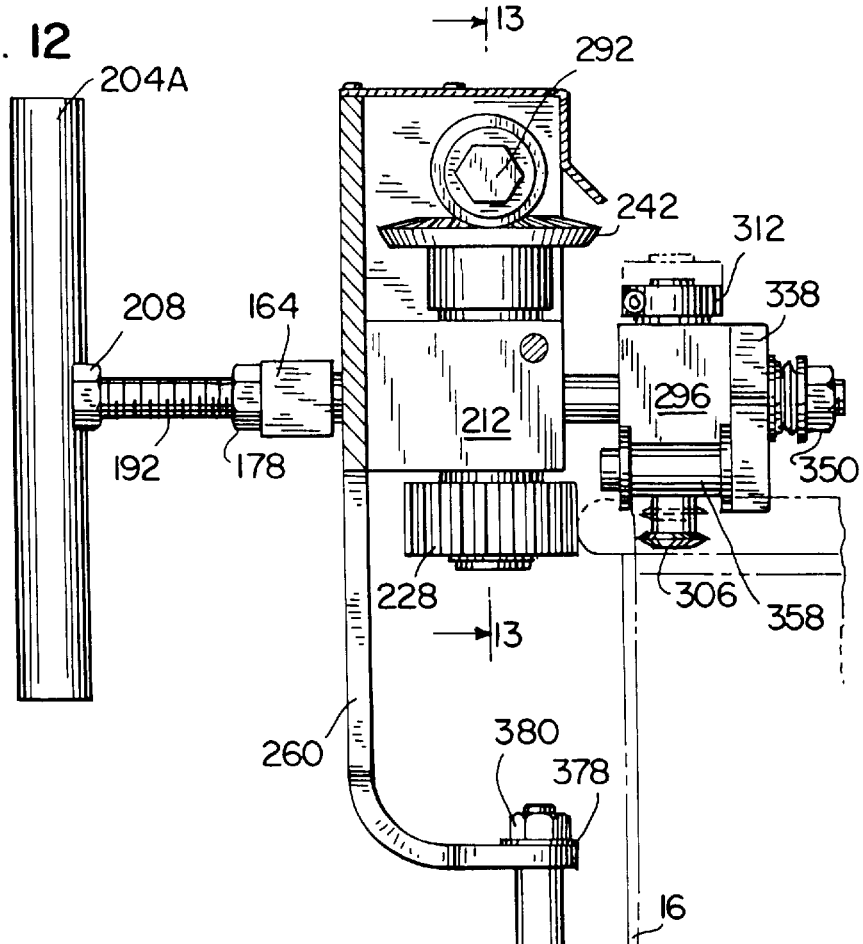
FIG. 12 is a side elevational view of the portable, manually powered metal drum opener shown in FIG. 9.

Referring in particular to FIG. 2, the portable, electric powered metal drum opener 10 has a carrier 34 to which other components of the opener 10 are mounted. The carrier 34 has a generally vertical drive shaft bearing hole 36. A hollow drive shaft 38 is journaled within the drive shaft bearing hole 36. Two needle bearings 40 and a bearing spacer 42 are mounted within the drive shaft bearing hole 36 in the carrier 34. The bearings 40 provide a bearing surface around the drive shaft bearing hole 36 against which the outer cylindrical wall of the drive shaft 38 is rotatably supported. The lower part 46 of the drive shaft 38 depends vertically below the carrier 34.

The drive wheel 24 is mounted around the lower part 46 of the drive shaft 38 using a drive wheel key 48 and a snap ring 50. The lower part 46 of the drive shaft 38 has a key slot (not shown) in an outer surface of the drive shaft 38. The drive wheel 24 has a key slot 54 in an inner annular surface of the drive wheel 24. The drive wheel key 48 resides partially in the key slot in the lower part 46 of the drive shaft 38 and projects therefrom. The drive wheel 24 is fixed to the drive shaft 38 by sliding the drive wheel 24 onto the lower part 46 of the drive shaft 38 so that the projecting part of the drive shaft key 48 resides in key slot 54 in the drive wheel 24. The snap ring 50 snaps into a circumferential groove 52 on the drive shaft 38 underneath the drive wheel 24 to lock the drive wheel 24 onto the drive shaft 38. A plug 56 is pushed into the hollow drive shaft 38 from the bottom. A snap ring 58 snaps into an upper circumferential groove 60 in the drive shaft 38 above the carrier 34 to mount the drive shaft 38 within the drive shaft bearing hole 36. A thrust bearing 43 is located around the drive shaft 38 between the top surface of the drive wheel 24 and the lower surface of the carrier 34. Another thrust bearing 44 is located around the drive shaft 38 between the snap ring 58 and the top surface of the carrier 34.

An electric direct current (DC) motor 62 is mounted to the top surface of the carrier 34 with screws 78. The electric DC motor has an output shaft 64 that drives the drive shaft 38. The electric DC motor 62 receives conventional AC electric power from a conventional power source through cord 66. Cord 66 is coiled to help prevent tangling of the cord 66 as the opener 10 moves around the upper end of the drum 14. The electric motor 62 has a rectifier that converts alternating current electricity supplied through plug 66 to direct current electricity to power the electric DC motor 62. The electric DC motor 62 is preferably a ⅛ horsepower electric DC motor. A direct current motor is preferred over an alternating current motor because direct current motors build torque as motor speed is restrained. This characteristic allows a direct current motor 62 to better accommodate kinks in the chime 22 without stalling the motor 62. It has been found that ⅛ horsepower DC motor 62 is suitable to drive the opener 10 around the drum 14, and contemplate reasonable kinks in the chime 22, when the cutter head 28 is engaged against the inner surface 30 of the chime 22 with sufficient force to cut the inside layer 30 of the chime 22 after two or three complete revolutions of the drum 14.

Referring in particular to FIG. 8, the output shaft 64 of the DC motor 62 is mounted within the inside cylindrical wall 68 of the hollow drive shaft 38. The diameter of the output shaft 64 is less than the diameter across the inside cylindrical wall 68 of the drive shaft 38 so that a clearance 70 is provided between output shaft 64 and the inside wall 68 of the drive shaft 38. The diameter of the output shaft 64 is preferably 0.625 inches and the diameter across the inside wall 68 of the drive shaft 38 is preferably 0.69 inches, so the clearance is preferably about 0.065 inches. The clearance 70 allows the output shaft 64 to move slightly within the drive shaft 38, thus eliminating or at least reducing transverse loads on the output shaft 64. The output shaft 64 provides power to rotate the drive shaft 38 through an output shaft key 72 that resides in a key slot 74 in the output shaft 64 and in a key slot 76 in the inside cylindrical wall 68 of the drive shaft 38.

A cutter assembly 84 is slidably mounted to the carrier 34. The cutter assembly 84 has a front housing 86 with a generally vertical cutter shaft bearing hole 88. Bearing 96 and spacer 98 are located in the vertical cutter shaft bearing hole 88 to provide a bearing surface. A cutting wheel 90 has a cutting head 28 and a cutter shaft 92 projecting perpendicularly therefrom, the cutter shaft 92 is slidably mounted through the bearing 96 in the cutter shaft bearing hole 88. The upper part of the cutter shaft has threads 94. At least some of the threads 94 are exposed above the front housing 86 when the cutter shaft 92 is slidably mounted through the bearing 96 in the cutter shaft bearing hole 88. A collar 102 is screwed onto the exposed threads 94 of the cutter shaft 92. A thrust bearing 100 is located around the cutter shaft 92 between the collar 102 and the top surface of the front housing 86. The collar 102 (and/or the thrust bearing 100) acts as a stop to limit the lowest position relative to the front housing 86 that the cutting head 28 can slide. As more fully described below, the lowest relative position of the cutting head 28 will determine the height at which the chime 22 is cut.

The collar 102 preferably has a screw or socket type lock which locks the position of the collar 102 on the threads 94 when an appropriate chime cutting height has been selected. While the collar 102 limits the lowest relative position of the cutting head 28 with respect to the front housing 86, it does not by itself prevent the cutting wheel 90 from sliding upwards through the cutter shaft bearing hole 88 in the front housing 86.

The front housing 86 is supported on the drum chime 22 by chime rollers 104 and 106. The front housing 86 preferably has chime roller bracket 108 mounted on a side of the housing 86 facing the cutting direction 32 of the opener 10 and chime roller bracket 110 mounted on the trailing face of the front housing. The chime roller bracket 108 on the cutting direction 32 side of the front housing 86 has a threaded chime roller axle hole 112 through the bracket 108. The chime roller bracket 110 on the trailing side of the front housing 86 has a threaded chime roller axle hole 118 through the bracket 110. Chime roller 104 is rotatably mounted to the chime roller bracket 108 by screwing a chime roller axle 114 into the threaded chime roller hole 112. Washers 116 are used as chime roller guides for chime roller 104. Chime roller 106 is rotatably mounted to the chime roller bracket 110 by screwing a chime roller axle 120 into the threaded chime roller hole 118. Washers 122 are used as chime roller guides for chime roller 106. The position of the chime roller hole 112 in the chime roller bracket 108 on the cutting direction side of the front housing 86 is higher relative to the front housing 86 than the position of the chime roller hole 118 in the chime roller bracket 110 on the trailing side of the front housing 86.

As can best be seen in FIG. 5, the above described relative heights of the threaded chime roller axle holes 112 and 118 tilts the opener 10 downward towards the cutting direction 32. In particular, the front housing 86 is tilted downward in the cutting direction 32, and the cutting head 28 likewise tilts downward in the cutting direction 32. By tilting the cutting head 28 downward in the cutting direction 32, the cutting head 28 would tend to move downward along the chime 22 when the cutting head 28 is engaged and the opener 10 is moving around the drum chime 22. However, the cutting head 28 is physically restrained from moving downward past a selected chime cutting height by the collar 102 (and/or thrust bearing 100) abutting against the top surface of the front housing 86. Therefore, by adjusting the position of the collar 102 on the threads 94 of the cutter shaft 92, the chime cutting height can be adjusted (see FIG. 3).

The cutting assembly 84 in general, and the front housing 86 in particular, are slidably mounted to the carrier 34 using guide shafts 124 and 126. Referring in particular to FIG. 2, bearings 128 are located in guide shaft bearing holes 80 and 82, and the guide shafts 126 and 124 are slidably mounted through the bearings 128 in holes 80 and 82, respectively. Guide shaft 126 has a central bearing portion 130, a front portion 132 with threads having a smaller diameter than the central bearing portion 130, and a shoulder 134 between the central bearing portion 130 in the front portion 132. A compression spring 136 is located around the central bearing portion 130 of the guide shaft 126 between the carrier 34 and the front housing 86. The front portion 132 of the guide shaft 126 passes through a guide shaft hole 138 in the front housing 86 and is spring mounted to front housing 86. The shoulder 134 abuts against the front housing 86 when the guide shaft 126 is mounted to the front housing 86.

The guide shaft 126 is spring mounted to the front housing 86 by tightening a nut 140 onto the threads on the front portion 132 of the guide shaft 126 and by placing disk spring washers 142 between the nut 140 in the front housing 86. A flat washer 144 is preferably located between the front housing and the disk spring washers 142, and also between the disk spring washers 142 and the nut 140. In the embodiment shown in FIGS. 1–8 having an electric ⅛ horsepower DC motor 62, it is preferred that each disk spring washer 142 have a 0.042 inches displacement capacity, and a spring force of 300 pounds when fully displaced. As shown in FIG. 6, it is preferred to use five disk spring washers of this type between the nut 140 and the front housing 86. It is preferred that the five disk spring washers 142 be placed in a back to back and face to face configuration as shown in FIG. 6, so that the spring mount allows sufficient displacement to allow the cutting head 28 to deflect when the cutting head 28 encounters kinks in the chime 22.

Guide shaft 124 is preferably identical to guide shaft 126. Guide shaft 124 has a central bearing portion 146, a front portion 148 with threads, and a shoulder 150. A compression spring 152 is located around the central bearing portion 146 between the carrier 34 and the front housing 86. The front portion 148 of guide shaft 124 is mounted through a guide shaft hole 154 in the front housing 86 so that the shoulder 150 abuts the front housing 86. A nut 156 tightens onto the threads in the front portion 148 of the guide shaft 124, and flat washers 158 and disk spring washers 160 are used to spring mount the guide shaft 124 to the front housing 86.

The compression springs 136 and 152 preferably have a 2.5 inch free length and a 25 pounds per inch spring rate. The compression springs 136 and 152 push the front housing 86 away from the carrier 34 when the cutting head 28 is disengaged from the chime 22.

A rear portion 162 of the guide shaft 126 is mounted through a hole in a rear housing 164 using a flat washer 166 and a nut 170. A rear shoulder 172 on the guide shaft 126 is tightened against the rear housing 164 when nut 170 is tightened. Likewise, guide shaft 124 has a rear portion 174 that is mounted through another hole in the rear housing 164 by tightening a flat washer 176 and the nut 178 until a rear shoulder 180 of the guide shaft 124 is tightened against the rear housing 164.

The rear housing 164 has a generally horizontal threaded push rod guide hole 190. A threaded push rod 192 is screwed through the threaded push rod guide hole 190 in the rear housing 164. The threaded push rod 192 has a non-threaded front portion 194 which has a smaller diameter than the remaining portion of the threaded push rod 192. The front portion 194 of the push rod 192 abuts against a hardened steel plug 196 located in a cylindrical push rod opening 200 in the carrier 34. A piece of tubing 202 is slid over the threaded push rod 192, and a nut 208 and a T-bar handle 204 are screwed onto a rear end 206 of the threaded push rod 192.

A guide roller bracket 182 is attached to the rear surface of the carrier 34 by screws 184. The guide roller bracket 182 depends from the carrier 34, and guide rollers 186 and 188 are attached to the bottom of the bracket 182. The guide rollers 186 and 188 are disposed to engage the metal drum side wall 16, and stabilize the opener 10 as the opener travels around the drum 14.

Referring in particular to FIG. 7, the T-bar handle 204 can be turned to push the rear housing 164 against the guide roller bracket 182 and push the carrier 34 towards the front housing 86 to engage the cutting head 28 to cut the inside layer 30 of the chime 22. As the T-bar handle 204 is turned, the drive wheel 24 engages the outer surface 26 of the chime 22, and the cutting head 28 is pulled towards the drive wheel 24 in the direction of arrows 209 to cut the inside layer 30 of the chime 22. Once the cutting head 28 is engaged to cut the inside layer 30 of the chime, the electric DC motor 62 can be turned on to drive the drive wheel 24 and cause the opener 10 to travel around the upper end of the drum 14.

While it is possible to tighten the T-bar handle 204 tight enough so that the cutting head 28 cuts the inside layer 30 of the chime 22 in one revolution around the drum 14, it is preferred that the T-bar handle 204 be tightened only so far as required to fully cut the inside metal layer 30 of the chime 22 after two or three revolutions of the drum 14. This will allow the opener 10 to more easily encounter kinks in the chime 22 without stalling. It is preferred that the drive wheel 24 have a knurled edge with vertical teeth sized at about ten teeth per inch. This type of knurl on the drive wheel 24 provides sufficient traction for the drive wheel 24 against the outer surface 26 of the knurl 22.

FIGS. 9–15 show a portable, manually powered metal drum opener 210 in accordance with the invention. In many respects, the manually powered metal drum opener 210 shown in FIGS. 9–15 is similar to the electric drum opener 10 shown in FIGS. 1–8, and like reference numerals are used where appropriate to facilitate understanding of the invention.

The manually powered opener 210 has a carrier 212 having a generally vertical drive shaft bearing hole 214. Two bearings 216 and a spacer 218 are located within the drive shaft bearing hole 214 in the carrier 212. A solid generally cylindrical drive shaft 220 is rotatably mounted through the bearings 216 and the spacer 218 in the drive shaft bearing hole 214. An outer wall 222 of the solid drive shaft 220 has a lower key slot 224 and also an upper key slot 226. A drive wheel 228 has an axial hole 230 to receive the drive shaft 220, and an inside wall of the drive wheel 228 has a key slot 232. The drive wheel 228 is mounted to the drive shaft 220 by placing a drive wheel key 234 in the lower key slot 224 of the drive shaft 220 and in the key slot 232 in the drive wheel 228, and snapping a snap ring 236 into a circumferential groove 238 around the lower portion of the drive shaft 220 underneath the drive wheel 228. A thrust bearing 240 is located around the drive shaft 220 between the top surface of the drive wheel 228 and the bottom surface of the carrier 212.

The top of the drive shaft 220 extends above the top surface of the carrier 212. The top of the drive shaft 220 is operatively mounted to a beveled drive gear 242. The beveled drive gear 242 has a cylindrical hole 244 through its axis, and an inside cylindrical wall of the drive gear 242 has a key slot 246. The drive shaft 220 is operatively connected to the drive gear 242 by a drive gear key 248 that is located in the upper key slot 226 on the drive shaft 220 and in the key slot 246 in the drive gear 242. A snap ring 250 snaps into an upper circumferential groove 252 around the drive shaft 220 above the drive gear 242. A thrust bearing 254 is located between the bottom surface of the drive gear 242 and the upper surface of the carrier 212.

Figure 13:
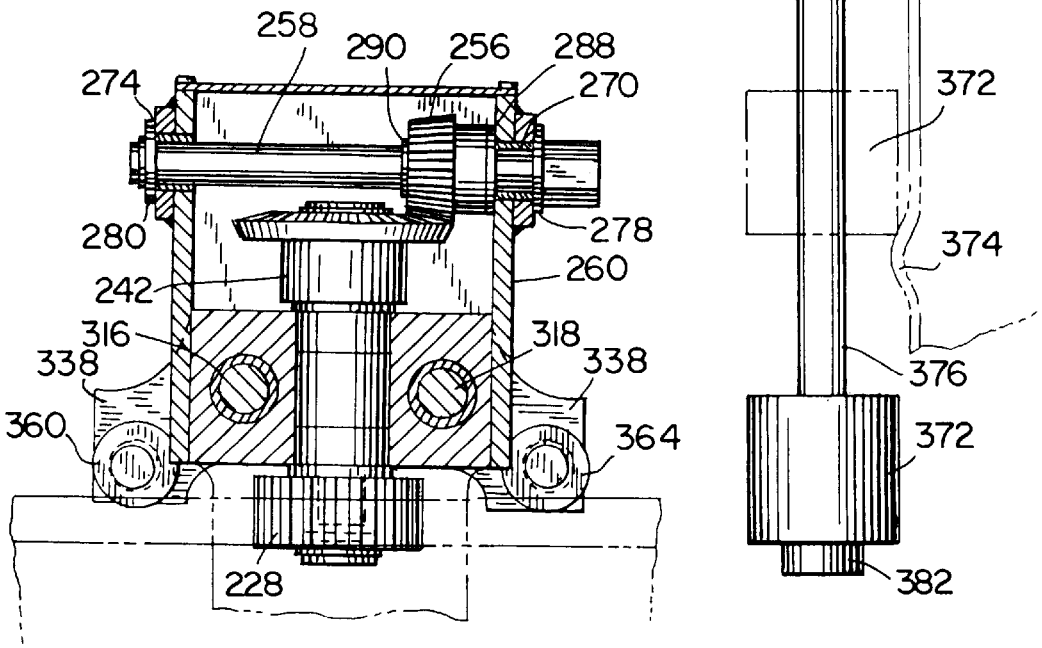
FIG. 13 is an elevational view taken along line 13—13 in FIG. 12.

As seen best in FIG. 13, the drive gear 242 is driven by a beveled pinion gear 256 mounted to a manually driven pinion shaft 258. It is preferred that the gear ratio between the pinion gear 256 and the drive gear 242 be in the range of 1:1 to 2:1.

The gear drive is housed by a guide roller bracket 260 which is attached to the carrier 212 by screws 262 and by a gear drive cover 264. The guide roller bracket 260 also supports the pinion shaft 258. The guide roller bracket 260 has two flanged generally horizontal pinion shaft support holes 266 and 268. Bearings 270 and 272 are located in pinion shaft holes 266 and 268, respectively. The pinion shaft 258 is rotatably mounted through bearings 270 and 272. A snap ring 274 snaps into a circumferential groove 276 in the pinion shaft 258 to secure the pinion shaft 258. Flat washers 278 and 280 can be used to hold the bearings 270 and 272 in holes 266 and 268, respectively.

The pinion shaft 258 has a longitudinal key slot 282. The pinion gear 256 has a cylindrical hole 284 through which the pinion shaft 258 is mounted. The cylindrical hole 284 through the pinion gear 256 has an inside wall with a key slot (not shown). The pinion shaft 258 is operatively connected to the pinion gear 256 using a pinion key 286 that resides in the longitudinal key slot 282 in the pinion shaft 258 and in the key slot in the pinion gear 256. A thrust bearing 288 is located between the guide roller bracket 260 and the pinion gear 256. A snap ring 290 snaps into a circumferential groove around the pinion shaft 258 to properly locate the pinion gear 256 with respect to the drive gear 242.

The pinion shaft 258 preferably has a ¾" hex-nut style head 292. A hand-held ratchet wrench 294 can be used to turn the head 292 of the pinion shaft 258 and in turn drive the drive wheel 228 and move the opener 210 around the upper end of the drum 14 in the cutting direction 32.

The portable, manually powered metal drum opener 210 has a cutting assembly slidably mounted through the carrier 212. The cutting assembly has a front housing 296 with a generally vertical cutter shaft bearing hole 298. Bearings 300 and spacer 302 are located in the vertical cutter shaft hole 298 to provide a bearing surface. A cutting wheel 304 having a cutting head 306 and a cutter shaft 308 projecting perpendicularly therefrom are slidably mounted through the bearings 300 in the cutter shaft bearing hole 298. A collar 312 screws onto threads 310 at the upper end of the cutter shaft 308 and can be used to adjust the chime cutting height as described above in conjunction with the electric metal drum opener 10 shown in FIGS. 1–8. A thrust bearing 314 is located between the collar 312 and the top surface of the front housing 296.

The cutting assembly, and in particular the front housing 296, is slidably mounted to the carrier 212 using guide shafts 316 and 318. The guide shafts 316 and 318 for the portable, manually powered metal drum opener 210, are similar in many respects to the guide shafts 126 and 124 for the portable, electric drum opener 10 shown in FIGS. 1–8, however it is preferred that the guide shafts 316 and 318 for the manually powered metal drum opener 210 be made of steel. The carrier 212 has two generally horizontal guide shaft bearing holes 320 and 322 with bearings 324 therein. The guide shafts 316 and 318 pass through the bearings 324 in holes 320 and 322, respectively. A front portion 326 of guide shaft 316 passes through a generally horizontal hole 328 through the front housing 296 so that a shoulder 330 on the guide shaft 316 abuts the front housing 296. Likewise, a front portion 332 of the guide shaft 318 passes through a generally horizontal hole 334 through the front housing 296 so that a shoulder 336 of the guide shaft 318 abuts the front housing 296. A separate chime roller bracket 338 is mounted against the front housing 296. The front portion 326 of the guide shaft 316 also passes through a hole 340 in the chime roller bracket 338. Likewise, the front portion 332 of the guide shaft 318 passes through a hole 342 in the chime roller bracket 38. The front housing 296 and the chime roller bracket 338 are spring mounted to the guide shafts 316 and 318 using nut 344, flat washers 346, and disk spring washers 348, and nut 350, flat washers 352, and spring disk washers 354, respectively.

Figure 14:
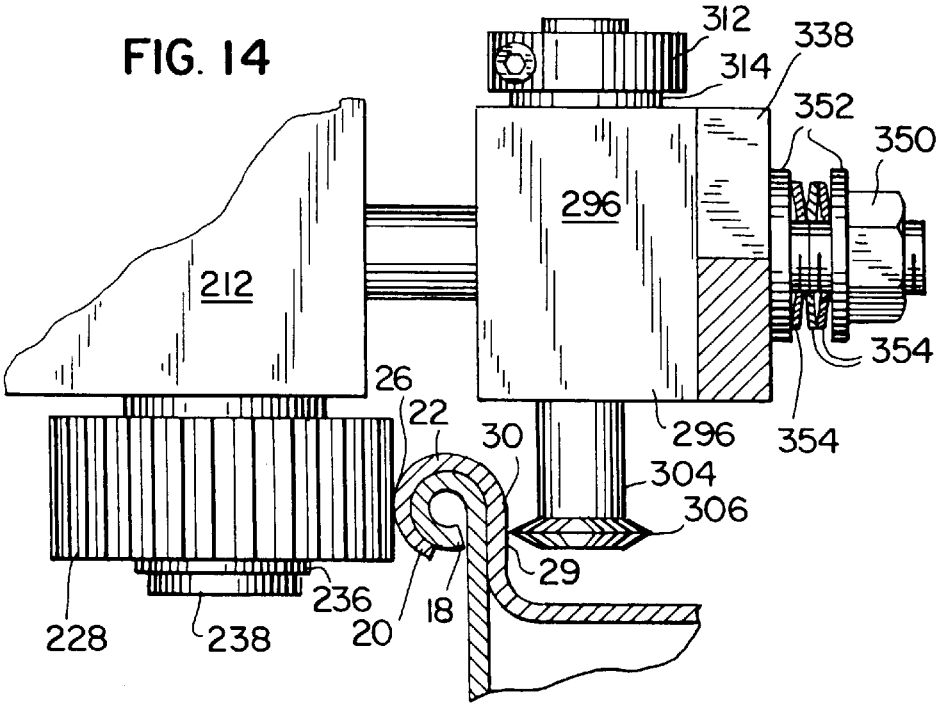
FIG. 14 is a detailed side elevational view of the portable, manually powered metal drum opener shown in FIG. 9.
Figure 15:
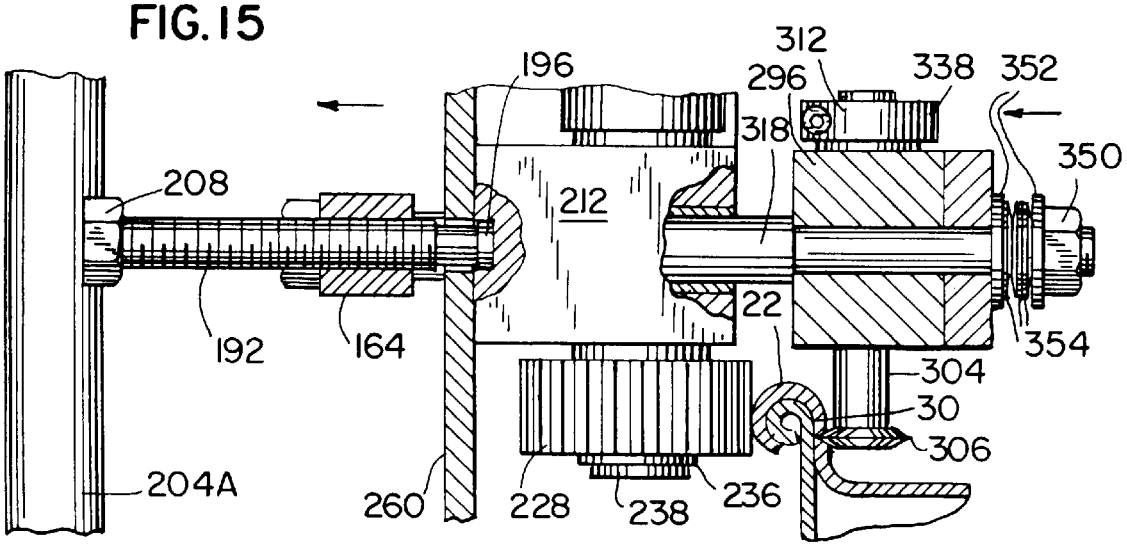
FIG. 15 is a side elevational view of a portion of the portable, manually powered metal drum opener shown in FIG. 9 showing a cutting head engaged against an inside metal layer of a chime to cut the inside metal layer of the chime.

Referring in particular to FIG. 14, it is preferred to use three disk spring washers 354 in a back to back and face to face configuration in the manual metal drum opener 210. It is preferred that each disk spring washer 354 have a 0.03 inch displacement capacity and a force of 870 pounds when fully displaced. It is preferred in the manual unit 210 to use relatively stiff three disk spring washers 354, instead of five disk spring washers 142 and 160 as used in the electric unit 10, because in the manual unit 210, it is desirable to fully cut the inside metal layer 30 of the chime 22 with one revolution of the opener 210 around the upper end of the metal drum 14. In order to do this, more force is required to cut through the kinks. However, some deflection is desirable.

Chime rollers 356 and 358 are attached to the chime roller bracket 338 by screwing chime roller axle 360 into a threaded chime roller hole 362, and chime roller axle 364 into threaded chime roller hole 366 respectively. Washers 370 are used as chime roller guides. In a manner similar to that discussed with respect to the electric opener 10 and shown specifically in FIG. 5, the chime roller axle hole 362 in the chime roller bracket 38 is located higher in the bracket 38 than the chime roller axle hole 366 at the trailing end of the chime roller bracket 338. The relative height difference between holes 362 and 366 causes the opener 210 to tilt downwards in the cutting direction 32, and in particular causes the cutting head 306 to tilt downwards in the cutting direction 32.

The manual metal drum opener 210 has a rear housing 164, a threaded push rod 192, a hardened plug 196, and a T-bar handle 204*a* that operate in a similar manner as like components in the electric unit 10, to engage the drive wheel 228 against the outer surface 26 of the chime 22 and the cutting head 306 against an inner surface 29 of the chime 22. The T-bar handle 204*a* for the manual unit 210 is preferably larger than the T-bar handle 204 for the electric unit 10 so that a user can turn the T-bar handle 204*a* for the manual unit 210 with two hands. This is preferred because the manual unit must push harder against the inside layer 30 of the chime 22.

The manually powered metal drum opener 210 does not transmit power to the drive wheel 228 at a relatively constant torque. It is therefore preferred that the drive wheel 228 have vertical teeth on the knurled edge that engages the outer surface 26 of the chime 22. Further, it is preferred that there be no more than ten teeth per inch around the knurled edge of the drive wheel 228. It is preferred that the drive wheel 228 be made of a material hard enough so that the teeth on the knurled edge of the drive wheel do not break easily. S7 tool steel is suitable for the drive wheel 228 in the manual unit 210. (S7 tool steel is also suitable for the drive 24 in the electric unit 10.)

The manually powered metal drum opener 210 can exert uneven pressures against the cylindrical drum side wall 16 which could dent the side wall 16 or otherwise cause the opener 210 to stall. In order to overcome this problem, the manually powered drum opener 210 uses guide rollers 372 that are substantially taller than the guide rollers 186 for the electric unit 10. In addition, the location of the guide rollers 372 can be adjusted to correspond to the height of a circumferential strength rib 374 in the cylindrical side wall 16 of the drum 14. In the preferred system, each guide roller 372 is slidably mounted to a vertical guide roller shaft 376 which depends from the guide roller bracket 260. The vertical guide roller shafts 376 are attached to the guide roller bracket 260 with a flat washer 378 and a bolt 380. The bottom of each guide roller shaft 376 has a guide roller stop 382. When the manually powered metal drum opener 210 is engaged on a drum 14, the guide rollers 372 support the opener 210 against the cylindrical side wall 16 of the drum to keep the metal drum opener 210 stable. The guide rollers 372 are slidably mounted to the guide roller shafts 376 and slide downward away from the opener 210 until a location where the circumferential strength rib 374 supports the guide rollers 376 from further sliding downward. The adjustable guide roller assembly as described herein, easily accommodates different style drums 14 in which the height of the circumferential strength rib 374 may differ.

It is recognized that various equivalents, alternatives, and modifications are possible within the scope of the invention and should be considered to fall within the scope of the appended claims. For instance, it should be apparent to one skilled in the art that there may be other means for driving the drive wheel, tilting the opener or the cutting head, spring mounting the cutting head to cushion against kinks in the chime, or adjusting the height of the cutting head and the guide rollers, and these other ways should be considered within the scope of the appended claims.

We claim:

1. A metal drum opener for removing a cover from a metal drum having a cylindrical wall in which an upper edge of the cylindrical wall and a peripheral edge of the cover are rolled to form a chime, the drum opener comprising:

a carrier having a generally vertical drive shaft bearing hole;

a drive shaft journaled within the drive shaft bearing hole;

a rotatable drive wheel mounted to the drive shaft and disposed to engage an outer surface of the drum chime;

a front housing having a generally vertical cutter shaft bearing hole;

a rotatable cutting wheel having a cutting head and a cutter shaft projecting perpendicularly from the cutting head, the cutter shaft being slidably mounted to freely slide through the cutter shaft bearing hole in the front housing so that the cutting head is disposed to engage an inner surface of an inside layer of the drum chime;

a cutting wheel stop that limits the cutter shaft from sliding axially downward through the cutter shaft bearing hole in the front housing beyond a selected chime cutting height relative to the front housing, a position of the cutting wheel stop on the cutter shaft setting the chime cutting height such that the cutting wheel is free to slide axially above the chime cutting height when the cutting head is not engaged with the drum chime;

means for engaging the drive wheel against the outer surface of the chime and the cutting head against the inner surface of the chime to cut the inside layer of the drum chime;

means for driving the drive shaft and moving the opener in a cutting direction around the drum chime to open the cover of the drum;

means for tilting the cutting head downward in the cutting direction as the opener moves around the drum chime; and wherein said means for tilting the cutting head downward in the cutting direction as the opener moves around the drum chime pulls the cutting head downward as the opener moves around the drum chime and the cutting wheel stop prevents the cutting head from moving downward beyond the selected chime cutting height by limiting axial downward movement of the cutter shaft through the cutter shaft bearing hole in the front housing.

2. A drum opener as recited in claim 1 further including means for adjusting the selected chime cutting height, said means for adjusting the selected chime cutting height comprising:

the cutter shaft has threads at an end opposite the cutting head and at least some of the threads are exposed above the front housing; and the cutting wheel stop is a threaded shaft collar that can be adjustably positioned onto the exposed threads of the cutting shaft.

3. A metal drum opener as recited in claim 1 wherein the means for tilting the cutting head downward in the cutting direction comprises:

first and second chime rollers that ride on the chime as the opener moves around the chime, the first chime roller rotatably supporting a first chime axle, the second chime roller rotatably supporting a second chime axle, the first and second chime axles supporting the metal drum opener on the drum chime so that the cutter head tilts downward towards the cutting direction.

4. A metal drum opener as recited in claim 1 wherein the means for tilting the cutter head downward in cutting direction comprises:

first and second chime rollers that ride on the chime as the opener moves around the drum chime, the first chime roller rotatably supporting a first chime axle which supports the front housing through a first chime axle hole in the front housing, the second chime roller rotatably supporting a second chime axle which supports the front housing through a second chime axle hole in the front housing, the first chime roller axle hole being located in the cutting direction and higher in the front housing relative to the second chime roller axle hole.

5. A drum opener as recited in claim 1 wherein the drive wheel has a knurled edge in which teeth on the knurled edge are substantially vertical, the drive wheel being mounted to the drive shaft so that the knurled edge is disposed to engage the outer surface of the drum chime and the means for driving the drive shaft is a manually powered gear drive.

6. A drum opener as recited in claim 5 wherein there are no more than ten teeth per inch around the knurled edge of the drive wheel.

7. A drum opener as recited in claim 5 wherein said engaging means has a spring element to cushion the engagement of the rotatable cutting head against the inner surface of the chime.

8. A drum opener as recited in claim 5 wherein the manually powered gear drive has a gear ratio in the range of 1:1 to 2:1.

9. A drum opener as recited in claim 5 further comprising:

a guide roller assembly attached to the carrier, the guide roller assembly having a guide roller shaft extending downward from the carrier and a rotatable guide roller slidably mounted to the guide roller shaft.

10. A metal drum opener for removing a cover from a metal drum having a cylindrical wall in which an upper edge of the cylindrical wall and a peripheral edge of the cover are rolled to form a chime, the drum opener comprising:

a carrier having a rotatable drive shaft depending therefrom and a drive wheel mounted to the drive shaft and disposed to engage an outer surface of the drum chime;

a cutter assembly having a rotatable cutting wheel depending therefrom and disposed to engage an inner surface of an inside layer of the drum chime, the cutter assembly being slidably mounted to the carrier;

means for engaging the drive wheel against the outer surface of the chime and a cutting head of the cutting wheel against the inner surface of the chime to cut the inside layer of the chime, said engaging means having a spring element to cushion the engagement of the cutting head against the inner surface of the chime by allowing the cutter assembly to move away from the carrier against spring pressure from the spring element when the cutting head engages against the inner surface of the chime to cut the inside layer of the chime and the cutting wheel encounters a kink in the chime; and means for driving the drive shaft and moving the opener in a cutting direction around the drum chime to open the cover of the drum.

11. A metal drum opener as recited in claim 10 wherein the drive shaft is driven by an electric direct current motor.

12. A metal drum opener as recited in claim 10 wherein the drive shaft is driven by a manually powered gear drive.

13. A metal drum opener as recited in claim 10 wherein:

the slidable cutter assembly further comprises a front housing having a generally vertical cutter shaft bearing hole and a generally horizontal guide shaft hole, a guide shaft having a front end that is mounted through the generally horizontal guide shaft hole in the front housing; and wherein the rotatable cutting wheel has a cutter shaft projecting perpendicularly from the cutter head, and the cutter shaft is rotatably mounted in the vertical cutter shaft bearing hole in the front housing so that the cutter head is disposed below the front housing to engage the inner surface of the chime, and wherein the cutter assembly is slidably mounted to the carrier by slidably mounting the guide shaft through the generally horizontal guide shaft bearing hole passing through the carrier.

14. A drum opener as recited in claim 13 wherein the front housing is spring mounted using disk spring washers around the front end of the guide shaft between the front housing and a nut used to mount the front end of the guide shaft to the front housing.

15. A drum opener as recited in claim 14 wherein the means for driving the drive shaft is an electric DC motor and there are five disk spring washers on the guide shaft between the front housing and the nut.

16. A drum opener as recited in claim 14 wherein the means for driving the drive wheel is a manually powered gear drive and there are three disk spring washers on the guide shaft between the front housing and the nut.

17. A metal drum opener for removing a cover from a metal drum having a cylindrical wall in which an upper edge of the cylindrical wall and a peripheral edge of the cover are rolled to form a chime, the drum opener comprising:

a carrier having a generally vertical drive shaft bearing hole;

a hollow drive shaft having a generally cylindrical outer wall and a generally cylindrical inside wall, the drive shaft being journaled within the drive shaft bearing hole so that the generally cylindrical outer wall of the hollow drive shaft bears on a bearing surface in the drive shaft bearing hole in the carrier;

a rotatable drive wheel mounted to the drive shaft and disposed to engage the outer surface of the drum chime;

a cutting head disposed to engage an inner surface of the drum chime opposite the rotatable drive wheel;

an electric direct current motor mounted to the carrier having an output shaft that resides within the inside wall of the drive shaft such that there is a clearance between the inside wall of the drive shaft and the output shaft of the electric motor, and a key that operatively connects the output shaft of the electric motor to the drive shaft.

* * * * *